US008500177B2

(12) United States Patent
Bartling

(10) Patent No.: US 8,500,177 B2
(45) Date of Patent: Aug. 6, 2013

(54) SAND SPREADING SYSTEM

(75) Inventor: Werner Bartling, Elze (DE)

(73) Assignee: Nowe GmbH, Elze (DE)

( * ) Notice: Subject to any disclaimer, the term of this patent is extended or adjusted under 35 U.S.C. 154(b) by 89 days.

(21) Appl. No.: 13/144,598

(22) PCT Filed: Jan. 15, 2010

(86) PCT No.: PCT/EP2010/050444

§ 371 (c)(1),
(2), (4) Date: Jul. 14, 2011

(87) PCT Pub. No.: WO2010/084085

PCT Pub. Date: Jul. 29, 2010

(65) Prior Publication Data

US 2011/0278863 A1 Nov. 17, 2011

(30) Foreign Application Priority Data

Jan. 22, 2009 (AT) ..... A 106/2009

(51) Int. Cl.
*B61C 15/10* (2006.01)

(52) U.S. Cl.
USPC ..... 291/25; 291/3; 291/32

(58) Field of Classification Search
USPC ..... 291/3, 11.1, 11.2, 25, 28, 32, 33, 291/34, 36, 41, 44
See application file for complete search history.

(56) References Cited

U.S. PATENT DOCUMENTS

| | | | | |
|---|---|---|---|---|
| 1,110,391 | A * | 9/1914 | Kett | 291/5 |
| 1,392,230 | A | 9/1921 | Shade | |
| 1,703,430 | A | 2/1929 | Pratte | |
| 1,776,688 | A * | 9/1930 | Pratte | 291/11.1 |
| 2,138,526 | A | 11/1938 | Nation | |
| 2,342,895 | A | 2/1944 | Saari | |
| 2,589,794 | A | 3/1952 | Frantz | |
| 3,345,097 | A | 10/1967 | Smith | |
| 2008/0012348 | A1 | 1/2008 | Knoss | |

FOREIGN PATENT DOCUMENTS

| | | | |
|---|---|---|---|
| AT | 403559 | B | 3/1998 |
| CN | 1946573 | A | 4/2007 |
| EP | 0882634 | A2 | 4/1998 |
| EP | 0882634 | A2 | 12/1998 |
| EP | 0936084 | A2 | 8/1999 |

OTHER PUBLICATIONS

English translation of International Preliminary Report on Patentability dated Aug. 18, 2011 for PCT/EP2010/050444.

(Continued)

*Primary Examiner* — Mark Le

(74) *Attorney, Agent, or Firm* — Fleit Gibbons Gutman Bongini & Bianco PL; Martin Fleit; Paul D. Bianco

(57) ABSTRACT

A system for spreading spreadings in front of the wheels of vehicles, in particular, rail vehicles, including at least one container for the spreadings, at least one device arranged below each spreadings container for metering the spreadings with an outlet opening for dispensing the metered spreadings and at least two devices for conveying the metered spreadings over at least two conveyor lines. The conveyor devices provided for the metering device are made up of a pneumatically operated multiple injector arranged beneath the outlet opening, with at least two separate cavities for the dispensing of the metered spreadings, with one compressed air connector per cavity, and a connector for the conveyor line in each cavity opposite the compressed air connection.

8 Claims, 8 Drawing Sheets

OTHER PUBLICATIONS

International Search Report published Jul. 29, 2010 for PCT/EP2010/050444, filed Jan. 15, 2010.
Written Opinion for PCT/EP2010/050444, filed Jan. 15, 2010.
International Preliminary Examination Report dated Apr. 14, 2011, Jul. 29, 2010 for PCT/EP2010/050444, filed Jan. 15, 2010.
Austrian Office Action dated Feb. 3, 2010, for PCT/EP2010/050444, filed Jan. 15, 2010.
First Office Action dated Apr. 26, 2013 with English translation for Chinese Patent Application No. 201080005030.1.

* cited by examiner

SAND SPREADING SYSTEM

FIELD OF THE INVENTION

The invention relates to a system for spreading grit in front of the wheels of vehicles, particularly rail vehicles, including at least one container for the grit, at least one device arranged below each grit container for metering the grit with an outlet opening for dispensing the metered grit, and a device for conveying the metered grit via a conveyor line to a vehicle wheel, wherein at least two devices for conveying the metered grit via at least two conveyor lines are associated to a metering device.

BACKGROUND OF THE INVENTION

Such spreading systems, by spreading grit in front of the wheels of vehicles, serve to increase the friction between a vehicle wheel and the ground, and hence reduce the braking distance and facilitate starting. Spreading systems are, in particular, used for rail vehicles, yet also for trucks or buses. Dry sand is, in particular, used as grit material. Yet, other suitable materials may be employed as well.

From U.S. Pat. No. 1,392,230 A, a sand spreading system for a rail vehicle is known, comprising a sand reservoir to the lower side of which a sand metering device is connected, which includes an internal passage opening that is closable by a slide. In the lower region of the sand metering device, three connections are provided to which a valve-controlled compressed-air device is associated to convey the sand to the vehicle wheels in conveyor lines.

U.S. Pat. No. 2,342,895 A describes a sand spreading device in which two conveyor lines are connected to a sand reservoir, wherein a metering device and a valve-controlled compressed-air device are provided.

From U.S. Pat. No. 2,138,526 A, a sand spreading device is known, which comprises a manifold provided in a sand reservoir and connected with three conveyor lines in a valve-controlled manner.

U.S. Pat. No. 1,776,688 A describes a spreading device comprising a sand reservoir arranged above a steam generator and connected with a duct on its lower side. A vacuum metering and conveying device transports the sand in two separate conveyor lines that end in the region of the wheels.

In the sand spreading device described in U.S. Pat. No. 3,345,097 A, a single sand conveyor line is connected to a reservoir.

U.S. Pat. No. 2,589,794 A describes a sand spreading device in which each drive wheel is connected with its separate sand metering means.

In addition, AT 403 559 B discloses a spreading device that transports the grit, particularly sand, according to the injector principle by the aid of compressed air via a suitable conveyor line to the desired location, i.e. the region immediately in front of the vehicle wheel.

EP 936 084 A2 describes a piston-controlled metering device for spreading systems, by which the metering of sand can be improved.

In conventional spreading systems, a metering device and a conveying device as well as a conveyor line are usually each associated to a grit container. For use with several vehicle wheels, the respective number of grit containers, metering devices, conveying devices and conveyor lines are required. Moreover, only relatively short conveyor line lengths have been feasible in conventional spreading systems, which is why the grit container plus metering device and conveying device have had to be arranged relatively close to the vehicle wheels. The respective system components have, therefore, been mounted in the immediate vicinity of the wheels, e.g. on the bogie of a rail vehicle, where they have been exposed not only to external influences like moisture and temperature, but also to mechanical influences.

The elevated number of grit containers plus associated components and their arrangement, for instance, in a rail vehicle also have increased mounting, maintenance and dismounting expenditures. The process of refilling an accordingly great number of grit containers, e.g. sixteen in a rail vehicle on both sides of the vehicle, has thus involved a lot of time and costs.

SUMMARY OF THE INVENTION

The object of the present invention consists in providing an above-identified spreading system by which the mounting and dismounting as well as maintenance expenditures can be reduced. The spreading system is to be as cost-effective as possible and avoid, or at least reduce, the drawbacks of known devices.

The object according to the invention is achieved in that the conveying devices associated to the metering device are comprised of a pneumatically operated multiple injector including at least two cavities for dispensing the metered grit, a compressed-air connection per cavity, and a connection for the conveyor line each located opposite the compressed-air connection of each cavity, said multiple injector being arranged below the outlet opening of the metering device.

For spreading grit in front of several wheels of a vehicle, a common grit container and at least one associated metering device are used, with the grit being apportioned to the respective number of conveying devices and conveyor lines. The number of grit containers with their associated metering devices can thus be markedly reduced, and the costs for the system components can consequently be lowered. Besides the prime costs, also the maintenance time, and hence costs, are reduced because fewer components need to be maintained and fewer grit containers need to be filled. Since new metering and conveying devices enable the bridging of larger distances between the grit container and the vehicle wheel to be spread, e.g. up to 20 meters, it has become possible to place the grit container in a suitable position within the vehicle. The central grit container together with the metering device and the conveying devices can thus be positioned in the vehicle where a structural free space is provided and the system components are less prone to environmental hazards and mechanical influences. This will, in turn, increase the service lives of the system components, or the system components may be formed to be accordingly less sturdy and hence more light-weight. According to a characteristic feature of the invention, it is therefore provided that the metering device, and conveying devices associated to the grit container, are comprised of the pneumatically operated multiple injector including at least two cavities for feeding the metered grit, a compressed-air connection per cavity, and a connection for the conveyor line each located opposite the compressed-air connection of each cavity, said multiple injector being arranged below the outlet opening of the metering device. The conveying device is thus able to transport the grit via at least two separate conveying devices. The at least two cavities for feeding the metered grit communicate with the outlet opening of the metering device so as to enable the grit metered from the grit container to reach all of the cavities of the multiple injector, and consequently all of the conveying lines.

The compressed-air connections and the conveyor line connections of the multiple injector can be adjacently arranged for conveying the grit in the same direction. With such a construction, all of the compressed-air connections are thus located on one side of the multiple injector, and the connections to all of the conveyor lines are located on the opposite side.

Alternatively, the compressed-air connections and the conveyor line connections of a multiple injector can be arranged in an alternatingly opposing manner for conveying the grit also in opposite directions. Thus, a double injector can, for instance, be created to transport the grit in two opposite directions, viewed from the grit container.

According to a further characteristic feature of the invention, it is provided that each multiple injector is made of aluminum. The production of this light metal is relatively simple and cost-effective. In addition, this material will impart the necessary corrosion resistance to the injector.

In a preferred manner, a seal is provided between the grit container and the metering device. Said seal is made of a suitable elastic material.

Furthermore, a seal of a suitable elastic material may likewise be provided between the metering device and each associated conveying device.

The metering device arranged below the grit container can, for instance, be formed by a rotatable cellular wheel comprising several blades, between which cells are formed, in which the grit can be received and metered into the consecutively arranged conveying device.

Alternatively, the metering device can also be formed by a piston control mechanism comprising an axially displaceable piston. In this case, metering of the grit is effected by the displacement of the piston and the thus resulting change of an opening gap in the connection between the grit container and the conveying device.

Finally, the metering device can also be formed by a frequency controller comprising a lifting magnet. By such a construction, it is possible to optimally control the conveyed amount of grit as a function of the vehicle speed.

According to a further characteristic feature of the invention, it is provided that the metering device and all of the conveying devices associated to said metering device are mounted in a common housing. This variant enables the formation of a modular unit to be rapidly and readily mounted and dismounted.

BRIEF DESCRIPTION OF THE DRAWINGS

The present invention will be explained in more detail by way of the annexed drawings. Therein.

DETAILED DESCRIPTION OF THE INVENTION

Figure 1A:
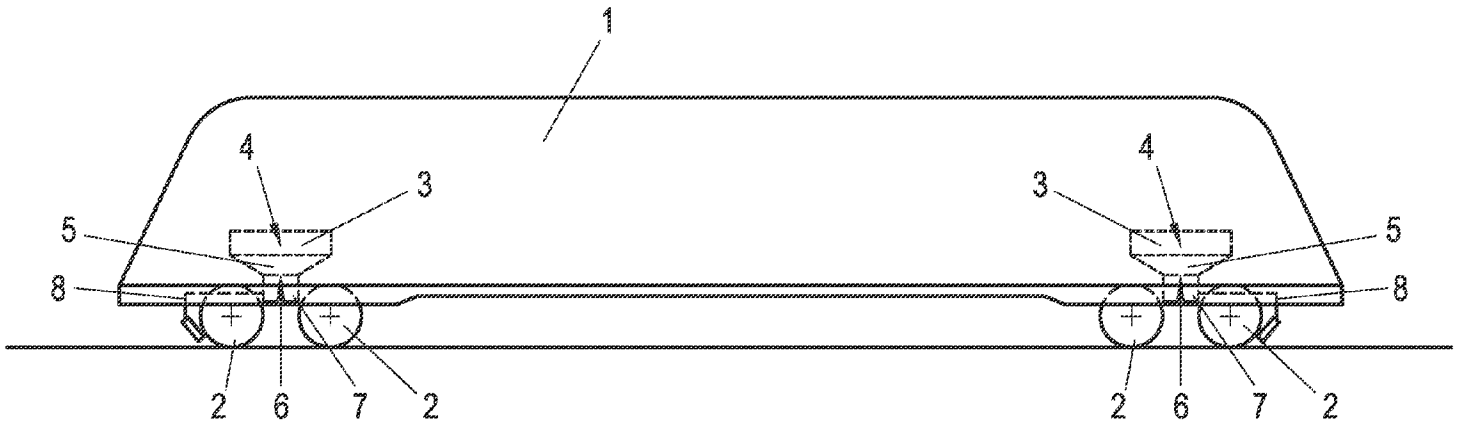
Fig. 1a (prior art)
FIGS. 1*a* and 1*b* depict a rail vehicle including a sand spreading system according to the prior art in a schematic side view and in top view, respectively.
Figure 1B:
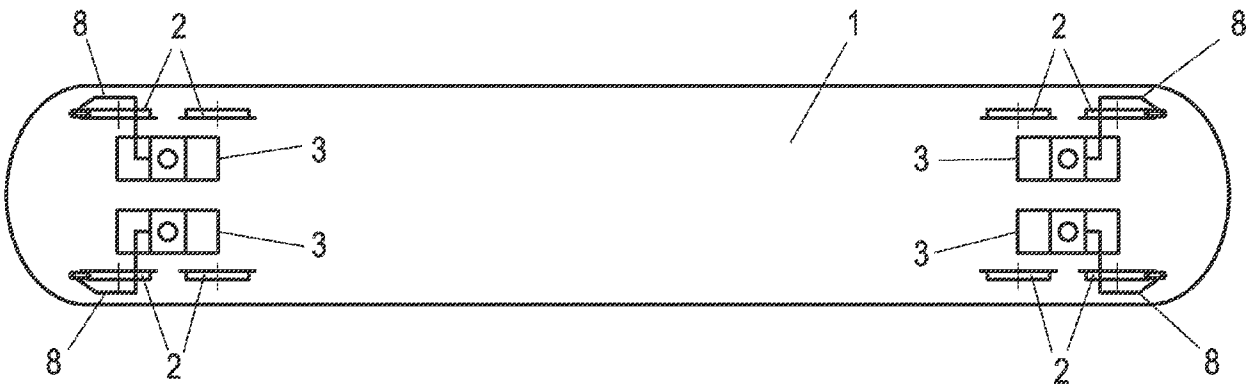
Fig. 1b (prior art)

FIGS. 1*a* and 1*b* depict schematic side and top views, respectively, of a rail vehicle 1, e.g. a locomotive, including a total of eight wheels, which are mounted on four axles. According to the prior art, a container 3 for receiving grit 4, particularly sand, is associated to each vehicle wheel 2 to be sanded. Below each grit container 3 is arranged a device 5 for metering the grit 4, which includes an appropriate outlet opening 6 for dispensing the metered grit 4. Below the outlet opening 6 of the metering device 5 is provided a device 7 for conveying the metered grit 4 via an appropriate conveyor line 8 to the vehicle wheel 2 to be sanded. Thus, a grit container 3, a metering device 5, a conveying device 7 and the respective conveyor line 8 are each required for a vehicle wheel 2 to be sanded. In the illustrated example according to the prior art, four spreading units including a total of four grit containers 4 are altogether arranged in the vehicle 1. Apart from the production costs for these system components and the increased mounting expenditures, the expenditures involved in filling this number of grit containers 3 are relatively high, since an appropriate refilling unit will have to be moved along both sides of the vehicle 1 for refilling the grit container 3. Furthermore, the length of the conveyor line 8 is strongly limited in conventional systems because of the way of metering and conveying the grit 4, which is why the system components have to be arranged relatively close to the vehicle wheel 2 to be sanded, e.g. in the region of the bogie of a rail vehicle. Both weathering influences and mechanical influences in the region of the bogie will adversely affect the system components, strongly limiting the service lives of the individual units and increasing maintenance expenditures.

Figure 2A:
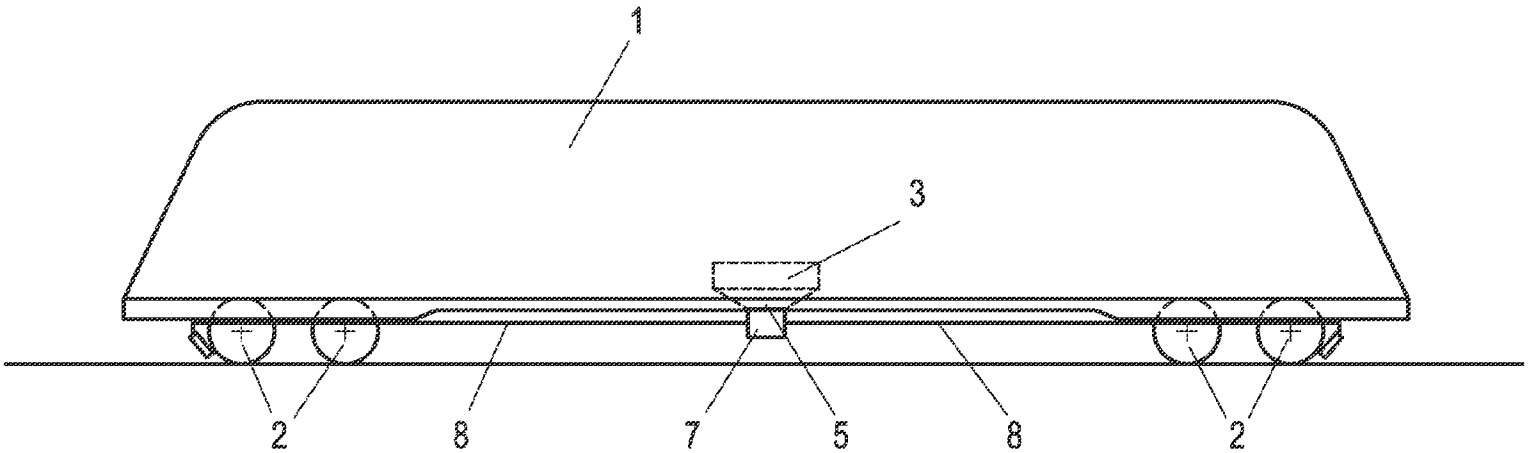
FIGS. 2*a* and 2*b* depict a rail vehicle comprising the sand spreading system of the invention according to a first embodiment.
Figure 2B:
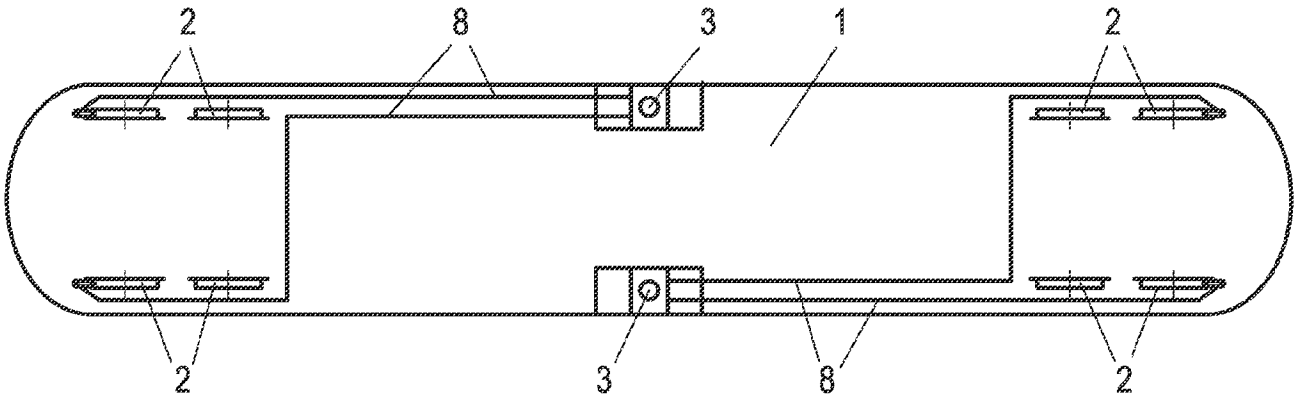

FIGS. 2*a* and 2*b* are schematic side and top views, respectively, of a rail vehicle 1 that is equipped with a spreading system according to the invention. Thus, two grit containers 3 each including a metering device 5 are, for instance, arranged in the center of the vehicle 1, and to each metering device 5 are associated two conveying devices 7 which transport the grit 4 to the vehicle wheels 2 to be sanded, via two conveyor lines 8. As in contrast to the variant embodiment according to FIGS. 1*a* and 1*b*, the number of grit containers 3 and metering devices 5 can thus be halved. Due to the reduced number of system components, the production price, yet even the mounting and dismounting expenditures and maintenance expenditures will be markedly decreased. Because of the separation of the metering device 5 from the conveying devices 7, it has now become possible to bridge larger distances between the conveying device 7 and the vehicle wheel 2 to be sanded. The grit containers 3 together with the associated metering device 5 and the associated conveying devices 7 can, therefore, be positioned in the vehicle 1 at an accordingly suitable location where they are, for instance, less strongly exposed both to weathering influences and to mechanical influences. This will, in turn, substantially increase the service lives of the system components. In the embodiment according to FIGS. 2*a* and 2*b*, the conveying devices 7 associated to a metering device 5 are configured such that the grit 4 to be conveyed is transported in the same direction via two appropriate conveyor lines 8. The spreading device illustrated at the bottom of FIG. 2*b* being activated when the vehicle drives to the right, and the spreading device illustrated on top being activated when the vehicle drives to the left.

Figure 3A:
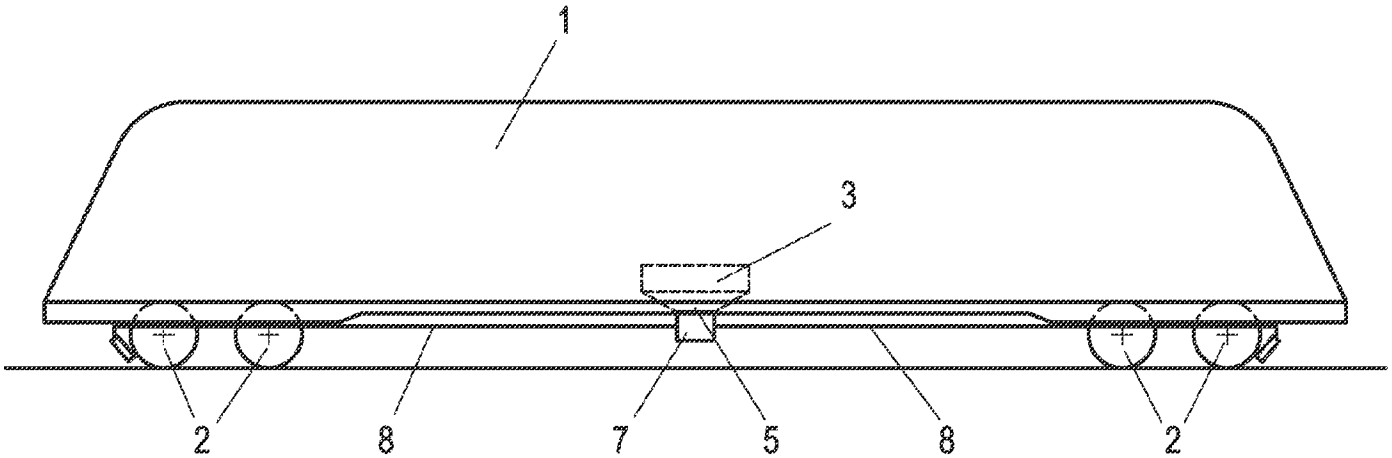
FIGS. 3*a* and 3*b* depict a rail vehicle comprising the sand spreading system of the invention according to a second embodiment.
Figure 3B:
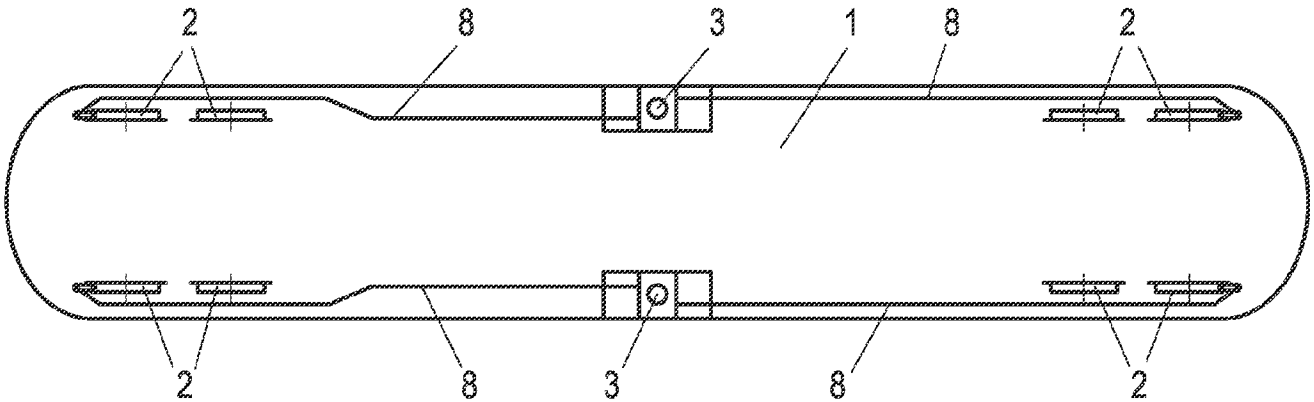

FIGS. 3*a* and 3*b* schematically depict a further embodiment of the spreading system according to the invention, wherein the conveying devices 7 respectively associated to a grit container 3 and a metering device 5 are configured to transport the grit 4 in opposite directions via appropriate conveyor lines 8. Details as to the configuration of the respective conveying device 7 are given in FIGS. 6 to 8 below.

Figure 4A:
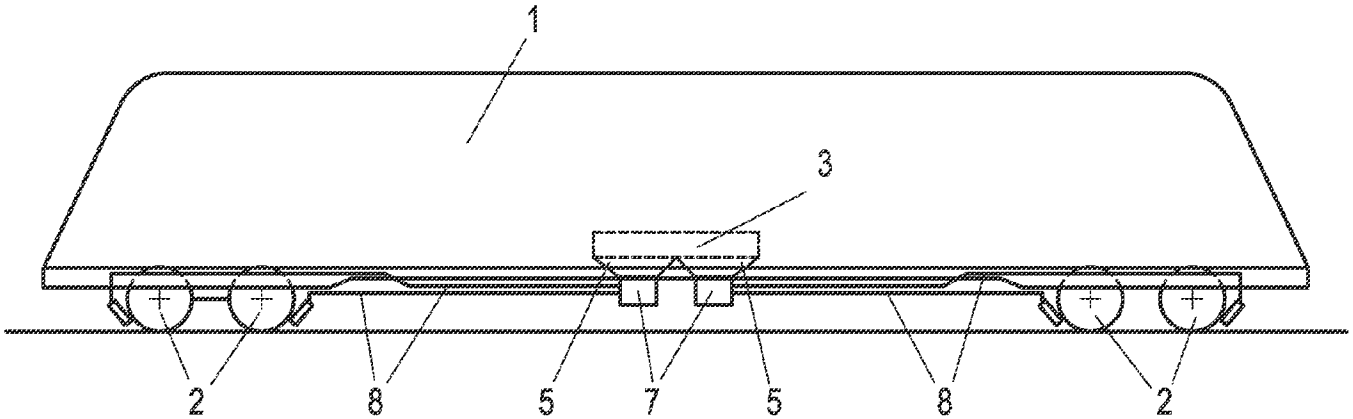
FIGS. 4*a* and 4*b* depict a rail vehicle comprising the sand spreading system of the invention according to a third embodiment.
Figure 4B:
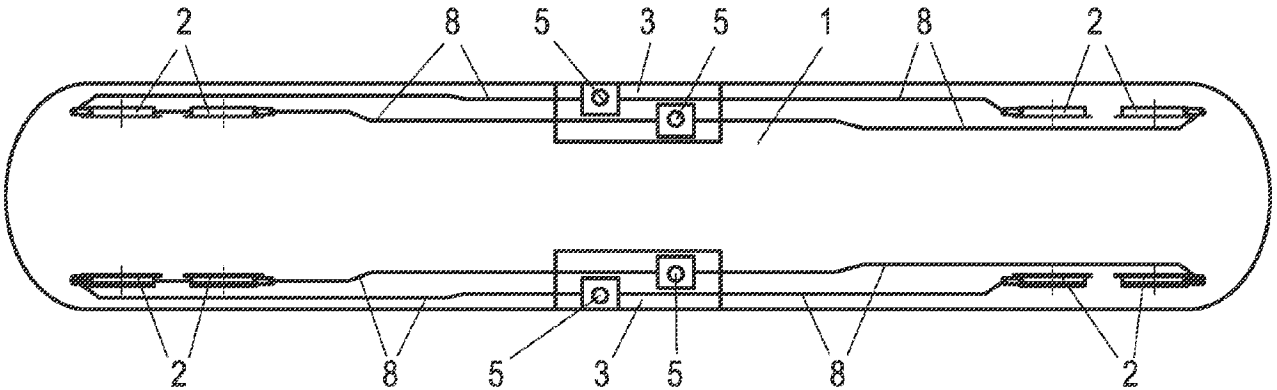

In the variant according to FIGS. 4*a* and 4*b*, all of the eight vehicle wheels 2 are sanded in that two centrally arranged grit containers 3 are each associated to two metering devices 5. To each metering device 5 are, in turn, associated two conveying devices 7, which transport the grit 4 to the respective vehicle wheels 2 in opposite directions via respective lines 8. Thus, only two grit containers 3, four metering devices 5 and a total of eight conveying devices 7 are required for sanding a total of eight vehicle wheels 2. According to the prior art, eight grit containers 3, eight metering devices 5 and also a total of eight conveying devices 7 were required to this end.

Figure 5A:
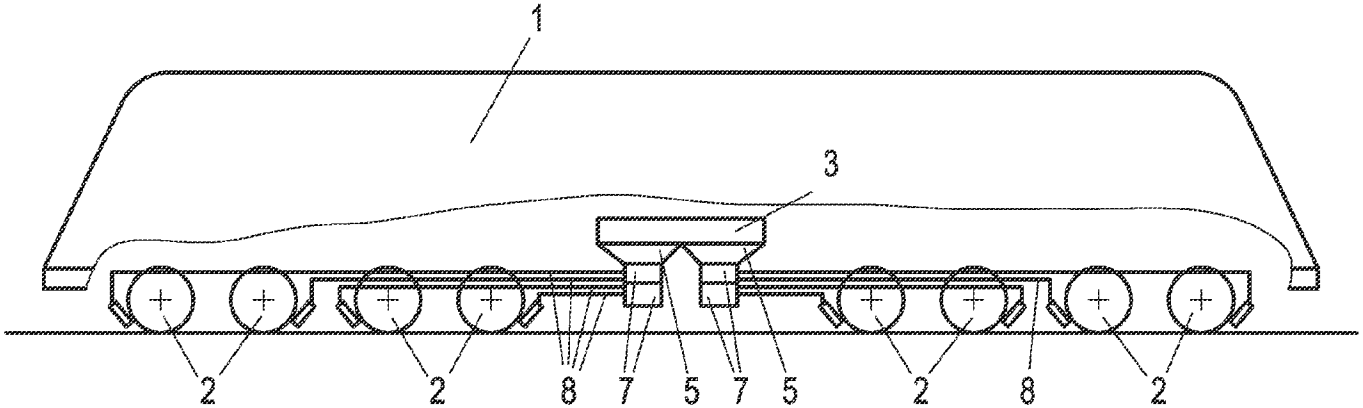
FIGS. 5*a* and 5*b* depict a rail vehicle comprising the sand spreading system of the invention according to a fourth embodiment.
Figure 5B:
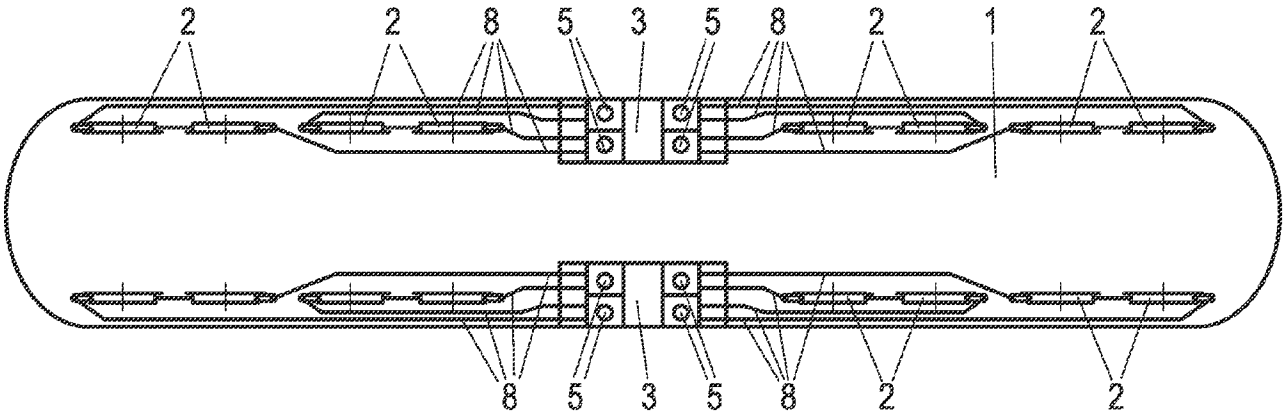

From the embodiment according to FIGS. 5*a* and 5*b*, the saving of system components relative to the prior art is particularly apparent. FIGS. 5*a* and 5*b* respectively depict a side view and a top view of a vehicle 1 comprising eight axles and a total of sixteen sanded vehicle wheels 2. The spreading system according to the invention merely requires two grit containers 3, wherein two metering devices 5 and a total of eight conveying devices 7 for conveying the grit via the respective conveyor lines 8 to the vehicle wheels 2 to be sanded are each associated to a grit container 3.

Figure 6:
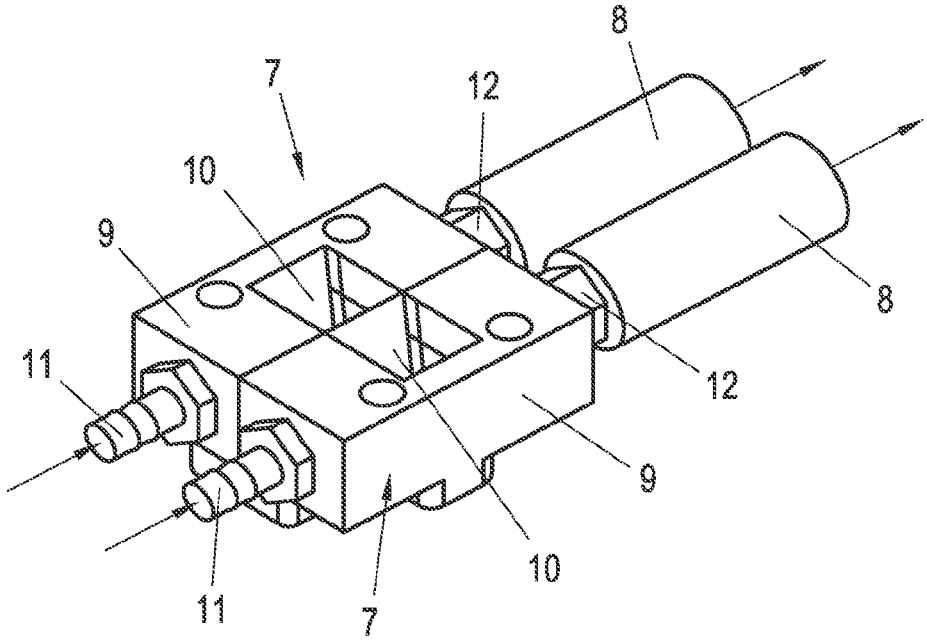
FIG. 6 is a perspective view of an embodiment of a conveying device that does not form part of the invention and comprises two individual injectors.

FIG. 6 is a perspective view of two conveying devices 7 in the form of two parallelly arranged single injectors 9. These pneumatically operated single injectors 9 each comprise a cavity 10 for charging the metered grit 4 from the outlet opening 6 of the metering device 5 (not illustrated). On one side, the cavity 10 is connected with a compressed-air connection 11, via which the respective compressed air is blown into the cavity 10 of the single injector 9. The negative pressure formed causes the grit 4 to be sucked into the cavity 10 and carried off to the vehicle wheel 2 to be sanded, via a connection 12 to the conveyor line 8, which connection 12 is located opposite the compressed-air connection 11. In the illustrated variant according to FIG. 6, the individual injectors 9 are arranged in a manner that the grit 4 will be transported in the same direction via two conveyor lines 8. The conveying devices 7 formed by the individual injectors 9 are fastened to the metering device 5 by suitable fastening means, optionally via interposed seals (not illustrated).

Figure 7:
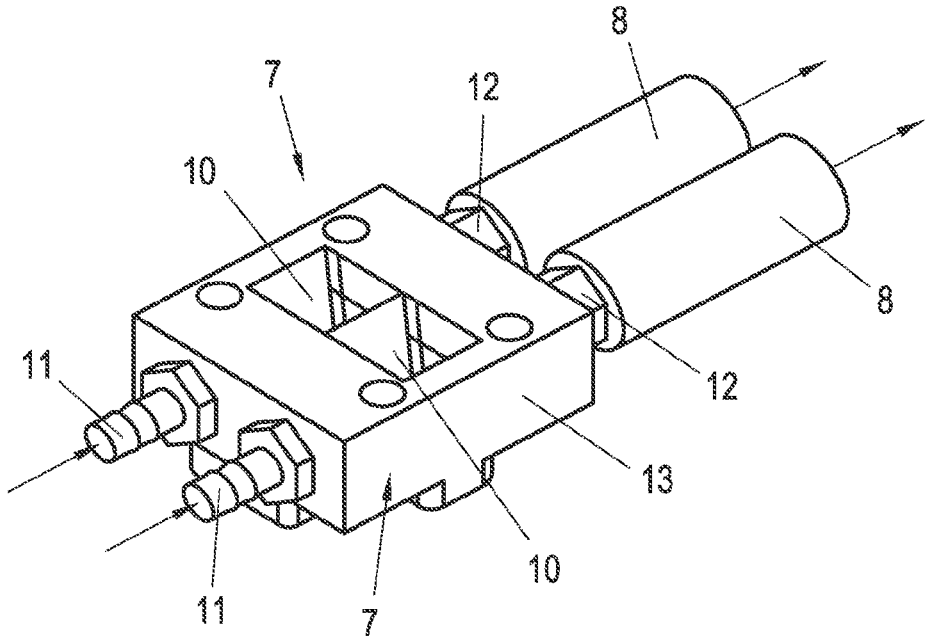
FIG. 7 is a perspective view of a conveying device according to the invention in the form of a multiple injector.

FIG. 7 illustrates a variant according to the invention as opposed to that of FIG. 6 and in which two conveying devices 7 associated to a metering device 5 are formed by a pneumatically operated multiple injector 13. This multiple injector 13, or double injector in the illustrated example, like the two adjacently arranged single injectors 9 according to FIG. 6, comprises two cavities 10 for charging the metered grit 4, two compressed-air connections 11 and two oppositely located connections 12 for the conveyor lines 8. Like the individual injectors 9, also the multiple injector 13 is preferably made of aluminum.

Figure 8:
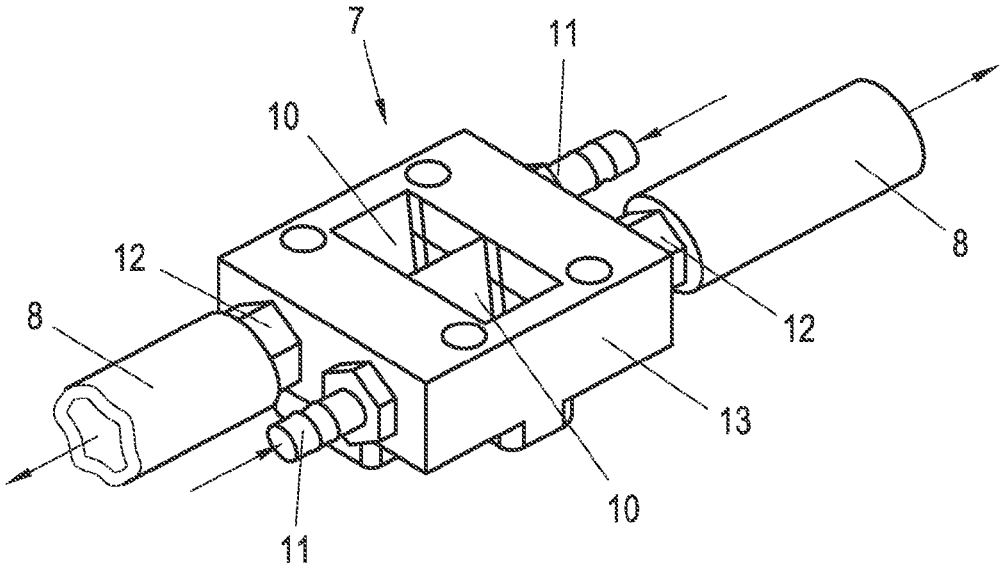
FIG. 8 is a perspective view of a further embodiment of a double injector comprising opposite grit conveying directions.

In the variant of a multiple injector 13 according to FIG. 8, the compressed-air connections 11 of the two cavities 10, and hence the respective connections 12 for the conveyor lines 8, are oppositely arranged so as to enable the transport of the grit 4 via the conveyor lines 8 in opposite directions. This construction is, for instance, advantageous for the grit system configuration according to FIGS. 3*a* and 3*b*.

Figure 9:
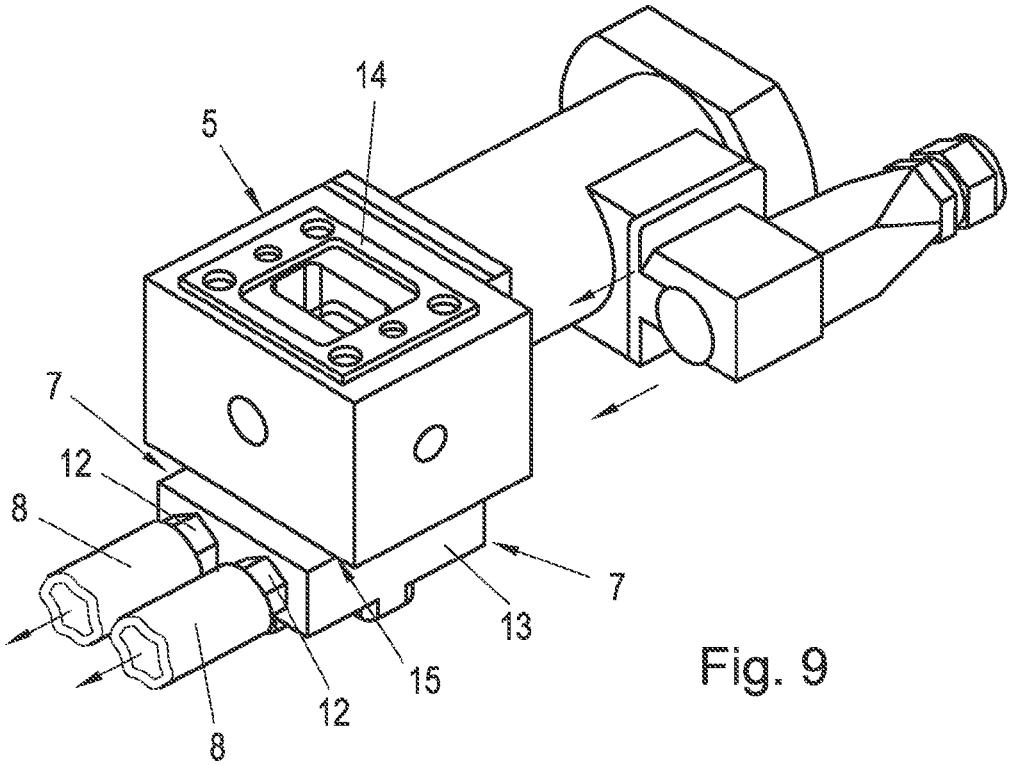
FIG. 9 is a perspective view of a double injector according to FIG. 7 with a superimposed metering device in the form of a cellular wheel control.

FIG. 9 depicts a perspective view of a multiple injector 13 according to FIG. 7 with a superimposed metering device 5 in the form of a cellular wheel control. This cellular wheel control comprises a rotatable cellular wheel, via which the grit 4 coming from the grit container 3 is metered and forwarded to the conveying devices 7.

Figure 10:
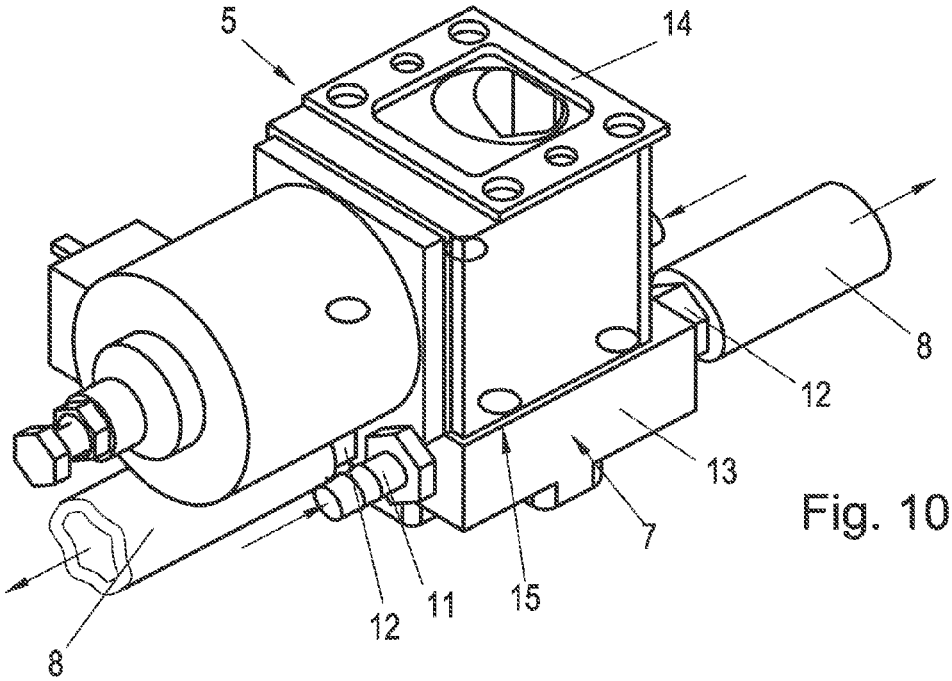
FIG. 10 is a perspective view of a double injector according to FIG. 8 with a superimposed metering device in the form of a piston control mechanism.

The variant embodiment according to FIG. 10 shows a multiple injector 13 according to FIG. 8, which is formed with a metering device 5 in the form of a piston control mechanism comprising an axially displaceable piston.

Figure 11:
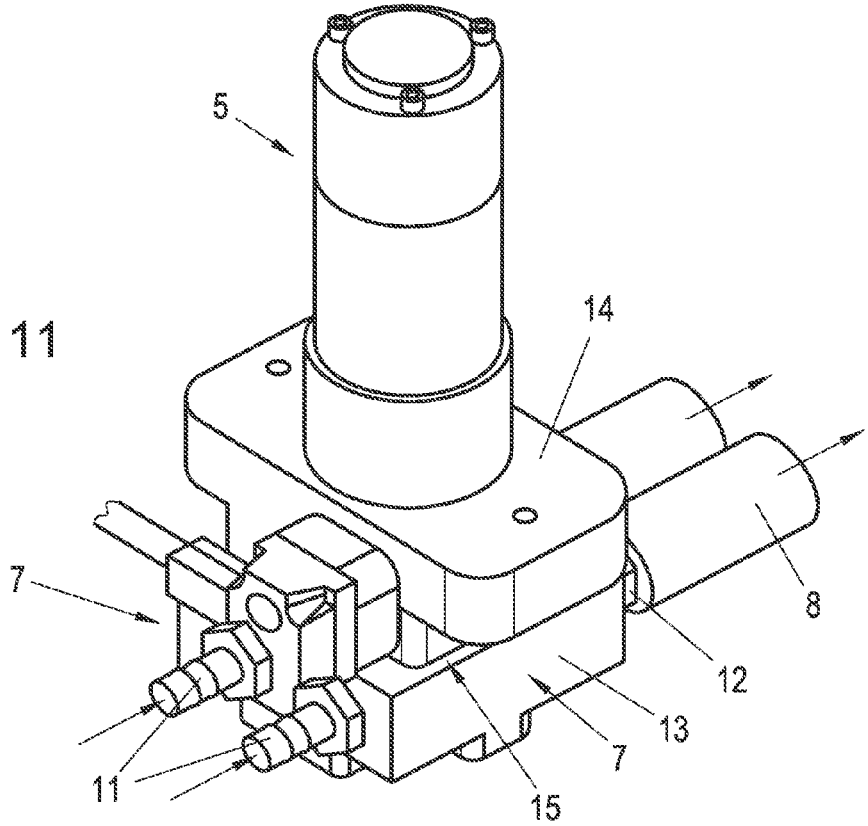
FIG. 11 is a perspective view of a double injector according to FIG. 7 with a superimposed metering device in the form of a frequency-controlled lifting magnet.

FIG. 11 finally illustrates an embodiment in which a multiple injector 13 according to FIG. 7 is connected with a metering device 5 comprised of a frequency controller including a lifting magnet. An appropriate seal 14 may each be provided between the metering device 5 and the grit container 3. A suitable seal 15 may likewise be provided between the metering device 5 and the conveying devices 7 or the multiple injector 13, respectively.

The illustrated Figures each only depict some exemplary embodiments of the spreading system according to the invention, which can also be realized with other metering devices 5 or conveying devices 7.

The invention claimed is:

1. A system for spreading grit (4) in front of wheels (2) of vehicles (1), particularly rail vehicles, said system including at least one container (3) for the grit (4), at least one device (5) arranged below each grit container (3) for metering the grit (4) with an outlet opening (6) for dispensing the metered grit (4), and at least two devices (7) for conveying the metered grit (4) via at least two conveyor lines (8) to a vehicle wheel (2), wherein the at least two devices (7) are associated to the metering device (5), wherein the metering device (5) is formed by a cellular wheel control comprising a rotatable cellular wheel or by a piston control mechanism comprising an axially displaceable piston or by a frequency controller comprising a lifting magnet, wherein the conveying devices (7) associated to the metering device (5) are comprised of a pneumatically operated multiple injector (13) including at least two separate cavities (10) for dispensing the metered grit (4), a compressed-air connection (11) per cavity (10), and a connection (12) for the conveyor line (8) each located opposite the compressed-air connection (11) of each cavity (10), said multiple injector (13) being arranged below the outlet opening (6) of the metering device (5).

2. A spreading system according to claim 1, wherein the compressed-air connections (11) and the conveyor line connections (12) of the multiple injector (13) are adjacently arranged for conveying the grit (4) in the same direction.

3. A spreading system according to claim 1, wherein the compressed-air connections (11) and the conveyor line connections (12) of the multiple injector (13) are arranged in an alternatingly opposing manner for conveying the grit (4) in opposite directions.

4. A spreading system according to claim 1, wherein each multiple injector (13) is made of aluminum.

5. A spreading system according to claim 1, wherein a seal (14) is provided between the grit container (3) and the metering device (5).

6. A spreading system according to claim 1, wherein a seal (15) is provided between the metering device (5) and each associated conveying device (7).

7. A spreading system according to claim 1, wherein the metering device (5) and all of the conveying devices (7) associated to said metering device (5) are mounted in a common housing.

8. A spreading system for spreading grit in front of wheels of a vehicles, the system comprising:

a container for holding the grit;

a metering device arranged below the container for metering the grit, the metering device having an outlet opening for dispensing the metered grit; and at least two conveying devices for conveying the metered grit via at least two conveyor lines to a vehicle wheel, the at least two conveying devices associated with the metering device, wherein the metering device includes a cellular wheel control comprising a rotatable cellular wheel; a piston control mechanism comprising an axially displaceable piston; or a frequency controller comprising a lifting magnet, wherein the at least two conveying devices includes a pneumatically operated multiple injector having at least two separate cavities for dispensing the metered grit, a compressed-air connection per cavity, and a connection for the conveyor line each located opposite the compressed-air connection of each cavity, said multiple injector arranged below the outlet opening of the metering device.

* * * * *